United States Patent [19]

Rosanio et al.

[11] 4,375,155

[45] Mar. 1, 1983

[54] REACH-IN REFRIGERATED DISPLAY CASE WITH AMBIENT AIR DEFROST

[75] Inventors: Ronald R. Rosanio, Levittown; John J. Jud, Philadelphia; Anthony Guaragno, Morrisville, all of Pa.

[73] Assignee: Emhart Industries, Inc., Farmington, Conn.

[21] Appl. No.: 334,416

[22] Filed: Dec. 24, 1981

[51] Int. Cl.[3] ..... A47F 3/04

[52] U.S. Cl. ..... 62/256; 62/282

[58] Field of Search ..... 62/256, 255, 82, 282

[56] References Cited

U.S. PATENT DOCUMENTS

| | | | |
|---|---|---|---|
| 3,850,003 | 11/1974 | Beckwith et al. | 62/256 X |
| 4,072,488 | 2/1978 | Johnston | 62/282 |
| 4,242,882 | 1/1981 | Abraham | 62/256 |
| 4,245,482 | 1/1981 | Abraham | 62/256 |
| 4,265,090 | 5/1981 | Ibrahim | 62/82 |
| 4,283,922 | 8/1981 | Subera et al. | 62/256 |
| 4,299,092 | 11/1981 | Ibrahim | 62/81 |
| 4,320,631 | 3/1982 | Vana | 62/282 X |

*Primary Examiner*—William E. Tapolcai

*Attorney, Agent, or Firm*—Frederick A. Zoda; John J. Kane; Albert Sperry

[57] ABSTRACT

A refrigerated display case, of the reach-in type having a door normally closing a customer access opening, utilizes ambient air for defrost purposes by channeling it through an inlet conduit at the bottom of the case. The air is introduced into the normal air circulation pattern that obtains during the refrigerating cycle of the case, at the intake sides of the otherwise conventional primary circulating fan and its adjacent evaporator coil. The arrangement avoids reversal of the normal air circulation pattern and maintains a small but noticeable air flow, during a defrost cycle, through the product display area and along the inside of the glass door surface. The inflow of ambient defrost air is directed into the case through a defrost air inlet conduit having at its outlet end a continuously open air supply port, which opens into the primary air duct to provide for said introduction of defrost air into the normal air pattern. Common to different forms of the invention are defrost air inlet and exhaust dampers that are normally closed during refrigeration cycles, but open together and remain open throughout each defrost cycle of the case.

17 Claims, 4 Drawing Figures

REACH-IN REFRIGERATED DISPLAY CASE WITH AMBIENT AIR DEFROST

CROSS-REFERENCE TO RELATED APPLICATIONS

The present application is related to contemporaneously filed patent application of George Edward Wallace, entitled "MULTIPLE DAMPER ASSEMBLY FOR REACH-IN CASES OF THE AIR DEFROST TYPE", application Ser. No. 334,482, filed Dec. 28, 1981.

BACKGROUND OF THE INVENTION

1. Field of the Invention

The present invention relates generally to the type of refrigerated display case commonly known as a "reach-in" case used in food stores and commonly having a glass door through which access is had to a product display space. In a more particular sense the invention relates to cases of this type in which the primary source of defrost heat is ambient air introduced into the case to flow through the evaporator. Thus, the case may be regarded as falling within the field of those in which the means for preventing or handling atmospheric condensate relative to the heat absorber means incorporated in the case, is a fluid—in particular, air—drawn from the surrounding ambient atmosphere.

Further with regard to the field of the invention, the introduction of the ambient air into a display case of the type having spaced, elongated air inlets and outlets providing an air curtain within the case that extends continuously about the product display area thereof, albeit with the added provision of a closed door that prevents impingement of ambient air upon the air curtain, is disclosed.

2. Description of the Prior Art

It is common to provide a reach-in display case with air defrost means adapted to introduce ambient air into the case for passage through the evaporator coil. The use of air defrost, as compared to electrical or hot gas defrost arrangements, has in recent years gained in popularity. It has been considered, for example, that air defrost may have advantages over defrost systems in which electrical resistance elements are the primary defrosters. In such instances, a considerable reduction in the expenditure of electrical energy may be anticipated. And, air defrost is preferred by some over "hot gas" defrost, by reason of its simplicity when compared against the additional piping, valving, and pressure controls required in the typical hot gas defrost system.

In reach-in, closed-door display cases of the air curtain type, it has been proposed to utilize ambient air for defrost purposes primarily by the operation of inlet and discharge dampers. These dampers, normally closed during refrigeration, are typically moved to open positions for communicating at least a part of the primary air passage with ambient at opposite sides of the coil. See, for example, U.S. Pat. No. 4,072,488 to Johnston issued Feb. 7, 1978; and U.S. Pat. No. 4,242,882 to Abraham issued Jan. 6, 1981.

Certain deficiencies have been noted in the prior art as typified by the above identified patents. It is believed desirable, for example, to provide a defrost system which will interfere minimally with the smooth flow of air during refrigerating cycles; that is to say, the air defrost system should not require baffling or restrictions that are aids during the defrost cycle, but which unfortunately remain present during refrigerating cycles to an extent that it inhibits the smooth, uniform flow of refrigerated air. Further, it is equally desirable to avoid relatively expensive components such as reversible primary fans, which are not only more expensive, but which in many instances do not operate in the reverse direction with the same efficiency as in their normal, forward direction.

In systems of this type, the incorporation of an air defrost arrangement is a trade-off in which, to gain the benefits of using ambient air as the heat source for defrosting a coil, it is necessary to accept a lower operating efficiency during refrigeration, or the incorporation of expensive components, or both. The present invention seeks to improve generally over the prior art by offering an air defrost system which attains high efficiency during defrost cycles with minimal reduction of operating efficiency in the refrigerating mode, and doing this without using expensive, trouble-prone mechanisms or assemblies.

SUMMARY OF THE INVENTION

The invention is disclosed in two forms, both of which have a common operating principle. The invention is incorporated in an otherwise conventional reach-in case. This, as is typical, has a continuous air flow, during refrigeration, about a product display space. Also typical is the mounting of an evaporator coil and a primary air circulating fan in the lower end of the case, offering maximum efficiency in drainage and in access to the refrigerating system. To this end, there is provided a defrost air inlet conduit which is separate from the primary air passage or duct through which refrigerated air normally flows, but which extends along the sides of the duct. In accordance with the invention, an inlet is provided for the conduit, communicating with ambient atmosphere and normally closed by an inlet damper. The inlet is at the rear end of the defrost air conduit, which itself is located below the primary air duct at the bottom end of the case. The inlet damper may be, and in a preferred form of the invention is, located at the upper end of the case remotely from the defrost air conduit inlet. In a second form of the invention the damper is located directly across the inlet. Air flowing through the inlet from the ambient atmosphere flows the full length of the defrost air conduit and is directed through a continuously open port that communicates between the defrost conduit and the primary duct. Here it is drawn through the coil by the primary fan, which continues to operate in the normal direction during defrost. Having passed through the coil, all but an inconsequential amount of the defrost air is discharged into the ambient atmosphere through an exhaust or discharge opening normally closed by an exhaust damper.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENTS

Figure 1:
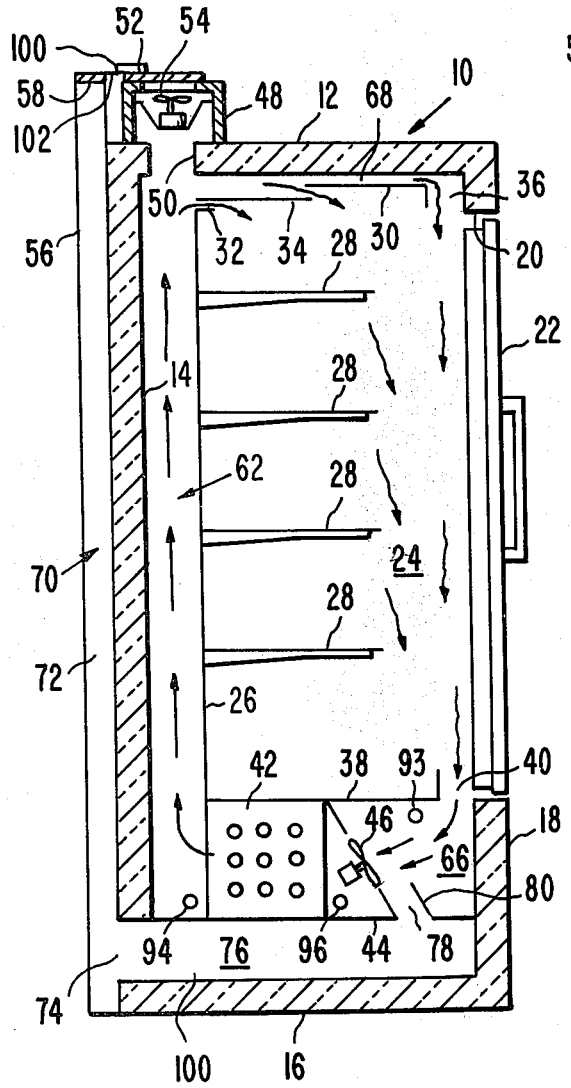
FIG. 1 is a vertical sectional view through a refrigerated display case of the reach-in type having a door normally closing the access opening to the product display space, equipped with the air defrost system comprising the present invention, the case being illustrated as it appears during a refrigeration cycle.
Figure 2:
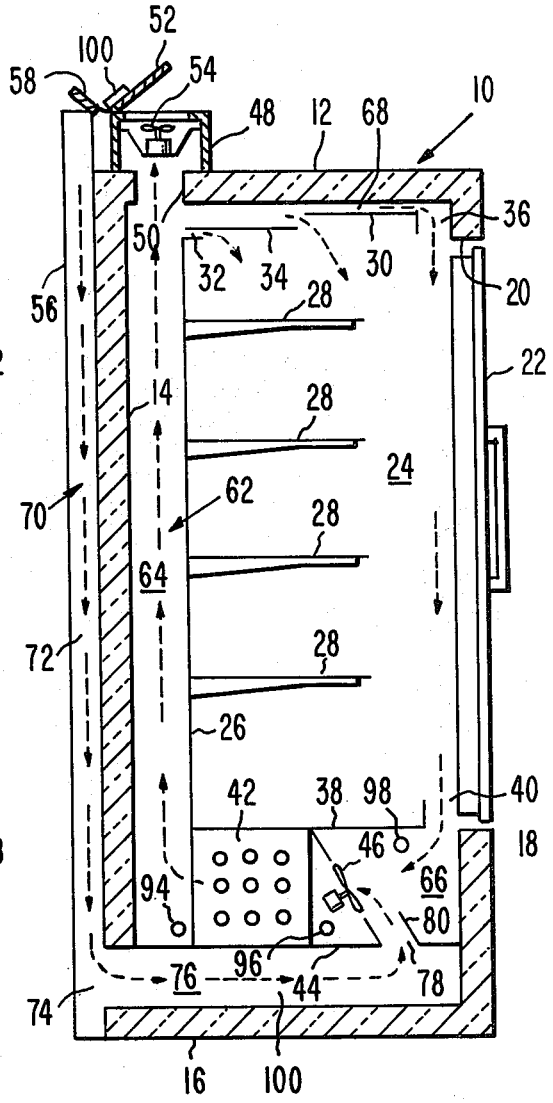
FIG. 2 is a view similar to FIG. 1 with the case in a defrost cycle.

In the form of the invention shown in FIGS. 1 and 2, the reach-in refrigerated display case 10 includes an insulated top wall 12, a rear wall 14, a bottom wall 16, a front wall 18 having an access opening 20, a door 22 normally closing the access opening, a product display space 24 the back of which is defined by an uninsulated rear duct wall 26, and a series of product shelves 28. An upper duct wall 30 has staggered rear, intermediate, and front air discharge nozzles 32, 34, 36 respectively. These offer three discharge areas for high velocity refrigerated air, which then circulates over the product on all levels. Air discharged from the front nozzle, in particular, travels down behind the door 22, helping to keep the glass clear and providing, also, an effective barrier against the intrusion of ambient air into the case when the door is open.

A lower duct wall 38 terminates short of the front wall 18, defining therebetween a primary air return inlet 40, through which refrigerated air normally passes as shown in FIG. 1 to flow through a coil 42 supported upon a horizontally disposed dividing wall 44. Mounted between walls 38, 44 is a non-reversible primary air circulating fan 46 which operates both during defrost and refrigerating cycles, to cause both refrigerated and defrost air to pass through the coil from right to left, viewing the same as in FIG. 1.

A case having a refrigerating system as described above is completely conventional, and in and of itself does not comprise part of the present invention.

In accordance with the present invention there is provided, on the top of the case, a defrost fan housing 48, the lower end of which is in continuous communication with the interior of the case through the provision of a defrost air outlet 50, the upper end of the housing being normally closed by a defrost air exhaust damper 52. Mounted in the housing is an air defrost fan 54, which operates only during defrost cycles.

Spaced rearwardly from and extending in parallel relation to the vertical rear wall 14 is a defrost air passage wall 56, extending the full height of the case so as to terminate at its upper end flush with the top surface of wall 12. This defines, between the walls 56, 14, a defrost air supply passage, the upper end of which is normally closed by a defrost air inlet damper 58.

As previously noted, operation of the primary fan 46 causes refrigerated air to pass about the product display space 24 as shown by the arrows in FIG. 1. Air refrigerated within the coil 42 exits the coil within the primary air passage or duct 62, in particular at the lower end of the rear duct portion 64 of the primary air passage. The refrigerated air, at the upper end of the rear duct portion 64, flows forwardly during each refrigeration cycle, for discharge into the product display space through nozzles 32, 34, 36, thereafter flowing through return 40 into plenum 66 and coil 42. The rear duct portion 64, the plenum 66, and an upper duct portion 68 together define the primary air passage or duct generally designated 62.

Up to this point, the construction illustrated and described is conventional, so far as the path of refrigerated air is concerned. It is an important feature of the invention that this wholly conventional path remain unobstructed by the presence of components required for defrost purposes, and that it retain its normal cross-sectional areas at all locations whereby during refrigeration, there will be exactly the same flow characteristics as have been present heretofore in conventional cases that have utilized defrost systems of, for example, the electrical or hot gas type. In other words, the refrigerated air flow pattern illustrated in FIG. 1 suffers no loss of operating efficiency during refrigeration cycles even though equipped with an air defrost system, which normally tends to require such expedients as baffles or restrictors and/or reversible motors or relatively complex, trouble-prone operating mechanisms.

In accordance with the invention, ambient air is introduced into the above mentioned refrigerated air flow pattern through a defrost air flue generally designated 70, which includes the defrost air supply passage 72, a defrost air inlet 74, and a defrost air inlet conduit 76. Flue 74 is thus of an L-shape, with its horizontal portion being defined by conduit 76, which extends fully from the rear to the front of the case, having at its rear end the inlet 74, and having adjacent its front end a defrost air supply port 78 that is continuously open and communicates conduit 76 with plenum 66 at the intake side of fan 46 and coil 42. A low deflector 80 is provided, preferably, at the port 78, but offers no interference with the normal refrigerated air flow pattern. It will be understood that to receive the melting frost from evaporator 42, a drain would be provided in conduit 76 below the coil. This drain is thus located in the path of ambient air passing, through conduit 76 during the defrost cycle, thus aiding in melting ice that may have formed on the drain during the preceding refrigerating cycle.

During defrost in the form of the invention shown in FIGS. 1 and 2, dampers 58, 52 are operated from their normally closed FIG. 1 positions. The means for operating these dampers may vary. The above mentioned related application discloses one mechanism that may be advantageously employed for this purpose.

Dampers 52, 58 open simultaneously with energizing of defrost air fan 54. Fan 46 continues to operate as it did during refrigeration. Air is thus caused to flow as indicated by the dashed-line arrows in FIG. 2, entering at the upper end of passage 72 to flow through inlet 74 and thereafter through the length of conduit 76 and port 78. The ambient air so introduced is circulated through coil 42 by fan 46, and passes upwardly through rear duct portion 64, being exhausted to ambient through damper-controlled exhaust outlet 50. Fan 54 increases the efficiency of the defrost operation, in particular speeding up the flow through coil 42 through maintenance of a continuous suction effect at the discharge side of fan 46.

An inconsequential amount of the defrost air drawn upwardly through duct portion 64 may be recirculated through the product display space by passage through nozzles 32, 34, 36 and then back to the plenum 66. The defrost air so recirculated, however, has no noticeable deleterious effect on the storage product and does not detract from the overall efficiency of the refrigerating system.

Figure 3:
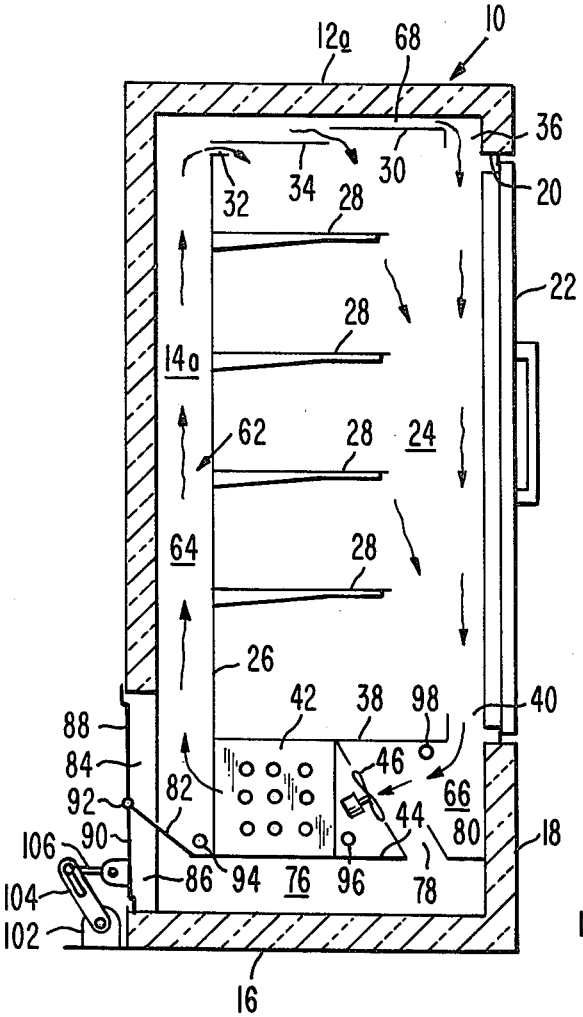
FIG. 3 is a view similar to FIG. 1 showing a modified construction, as it appears during a refrigerating cycle.
Figure 4:
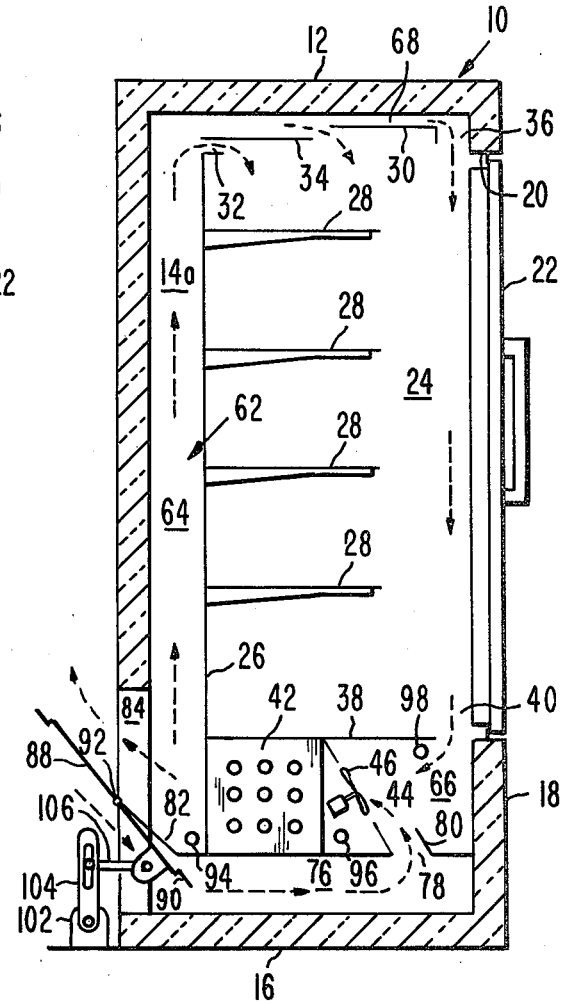
FIG. 4 is a view similar to FIG. 3 showing the modified case of FIG. 3 during its defrost cycle.

In the form of the invention shown in FIGS. 3 and 4, the case construction is identical to that previously described, except that the back wall 14*a* terminates short of the bottom wall 16. Wall 44 in this form has an upwardly rearwardly inclined extension 82, thus cooperating with bottom wall 16 and rear wall 14*a* in defining a defrost air exhaust outlet 84 and a defrost air inlet 86 normally closed, respectively, by outlet and inlet dampers 88, 90 integrally formed from a single sheet of material pivoted about a horizontal axis defined by pivot pin 92, between closed and open positions shown in FIGS. 3 and 4 respectively.

In both forms of the invention, although air drawn from the ambient atmosphere is used as the primary means for supplying heat for defrost purposes, it may be desirable to hasten the defrost through the use of supplemental electric heaters. For example, heaters can be located as at 94, 96, 98 at locations found to be particularly prone to frost build-up or locations that may otherwise be selected as being especially well adapted to supplement defrost of the coil by ambient air.

The means for operating the dampers between open and closed positions can vary. In the form of FIGS. 1 and 2, there is shown a cam 100 on damper 52, acting upon a rearwardly extending tongue 102 of damper 58. Opening of damper 52 causes cam 100 to bias damper 58 to open position. The means for opening the damper 52 can be the same as has been disclosed in the co-pending application Ser. No. 334,482, identified previously herein. The disclosure of that application is incorporated herein, accordingly, by reference.

With respect to the form of FIGS. 3 and 4, there could be provided, as a damper operator means, a motor 102 to the shaft of which is keyed a crank arm 104 having a longitudinal slot receiving a pivot pin 106 pivotally connected to the damper 90. A light, inexpensive gear reduction motor of the reversible type may be employed for this purpose.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. In a refrigerated display case of the air defrost type having refrigerating and defrost cycles, a display space, an air duct extending at least partially thereabout, a refrigerating coil mounted in the duct, and a primary fan also mounted in the duct and adapted for circulating air therethrough about the display space in the same direction during both the refrigeration and the defrost cycles thereof, the improvement comprising:

(a) a defrost air inlet conduit separate from and extending alongside said duct and having an inlet in communication with the ambient atmosphere and a defrost air supply port opening into the primary air duct;

(b) an inlet damper for admitting ambient defrost air through said inlet into the conduit for flow therethrough and through the defrost air supply port into the duct and thereafter through the coil during the defrost cycles of the case; and (c) an air exhaust damper for exhausting from the duct, into the ambient atmosphere, the air that has passed through the coil during said defrost cycles.

2. In a refrigerated display case the improvement of claim 1 wherein said port is continuously open.

3. In a refrigerated display case the improvement of claim 1 in which both of the dampers are closed during the refrigeration cycles of the case, and are open during the defrost cycles thereof.

4. In a refrigerated display case the improvement of claim 1 wherein the duct includes a plenum at the lower end of the case, said coil being mounted in the plenum.

5. In a refrigerated display case the improvement of claim 4 wherein the defrost air supply conduit underlies said plenum.

6. In a refrigerated display case the improvement of claim 5 in which said plenum and conduit extend generally horizontally from the front to the rear of the case for extending the flow path of the defrost air supply within the case.

7. In a refrigerated display case the improvement of claim 6 wherein said port and inlet are respectively disposed near the front and rear ends of the conduit, for travel of the ambient defrost air within the conduit over substantially the full length thereof prior to its flowing through the port into the plenum.

8. In a refrigerated display case the improvement of claim 7, further including a drain exposed to the incoming ambient defrost air supply within the conduit for facilitating the melting of ice that may form in said drain during the refrigerating cycles of the case.

9. In a refrigerated display case the improvement of claim 7 wherein said port is disposed at the inlet sides of the primary fan and coil.

10. In a refrigerated display case the improvement as in claims 3, 4, 5, 6, 7, or 9, further including a defrost air supply passage extending downwardly from the upper end of the case along the rear wall thereof and opening into communication with said conduit through the conduit inlet.

11. In a refrigerated display case the improvement of claim 10 wherein the inlet damper is mounted at the top of the case at the upper end of the defrost air supply passage.

12. In a refrigerated display case the improvement as in claim 11 wherein said duct has a rear duct portion extending upwardly along the rear wherein the portion of the case in side-by-side parallel relation with said inlet passage, the air exhaust damper being mounted at the upper end of said rear duct portion.

13. In a refrigerated display case the improvement as in claims 3, 4, 5, 6, 7, or 9 wherein the defrost air inlet opens through the rear of the case, said inlet damper being mounted upon said inlet.

14. In a refrigerated display case the improvement as in claim 13 wherein the air exhaust damper is mounted upon the rear of the case adjacent the inlet damper.

15. In a refrigerated display case the improvement as in claim 14 wherein dampers are connected for joint opening and closing thereof.

16. In a refrigerated display case the improvement as in claim 15 wherein the dampers are integrally joined and pivot about a common axis during their movement to their open and closed positions.

17. In a refrigerated display case the improvement as in claim 12 further including an air defrost fan mounted adjacent the air exhaust damper at the upper end of the rear duct portion operable conjointly with the primary air circulating fan during the defrost cycles of the case.

* * * * *